US005105646A

United States Patent [19]

Koskinen

[11] Patent Number: 5,105,646

[45] Date of Patent: Apr. 21, 1992

[54] PIPE BENDING PLIER

[75] Inventor: Kauno L. J. Koskinen, Hartola, Finland

[73] Assignee: Kauno Koskinen Ky, Hartola, Finland

[21] Appl. No.: 679,641

[22] Filed: Apr. 2, 1991

[51] Int. Cl.[5] ..... B21D 7/06

[52] U.S. Cl. ..... 72/389; 72/442; 72/477; 72/32

[58] Field of Search ..... 72/212, 213, 385, 389, 72/413, 442, 458, 477, 478, 410, 32; D8/14.1; 222/325, 326, 327

[56] References Cited

U.S. PATENT DOCUMENTS

| | | | |
|---|---|---|---|
| 1,079,442 | 11/1913 | Rutledge | 72/389 |
| 2,572,206 | 10/1951 | Sherbondy | 222/327 |
| 2,602,571 | 7/1952 | Sherbondy | 222/327 |
| 3,822,578 | 7/1974 | Le Breton | 72/389 |
| 4,459,839 | 7/1984 | Cochran et al. | 72/32 |
| 4,989,441 | 2/1991 | Wagner | 72/389 |

FOREIGN PATENT DOCUMENTS

| | | | |
|---|---|---|---|
| 213113 | 11/1957 | Australia | 72/389 |
| 204045 | 11/1983 | Fed. Rep. of Germany | 72/389 |
| 1353336 | 1/1964 | France | 72/389 |
| 265575 | 3/1950 | Switzerland | 72/389 |

*Primary Examiner*—David Jones

*Attorney, Agent, or Firm*—McAulay, Fisher, Nissen, Goldberg & Kiel

[57] ABSTRACT

A pipe bending plier, including a planar plate connected with a housing and a pair of spaced stationary anvil members coupled with the plate, a movable presser slidably coupled with the planar plate and movable relative to the housing and the anvil members, a movable handle for moving the movable presser towards the anvil members, a fixed handle coupled with the housing and a spring coupled with the housing for holding the movable handle away from the fixed handle, a pawl-ratchet mechanism housed within the housing and comprising an extension arm on a portion thereof carrying a ratchet, and a pawl connected with the movable handle, the ratchet being coupled with the movable presser and operatively associated with the pawl in one direction of movement of the extension arm for movement by the extension arm in one orientation thereof towards the pair of spaced stationary anvil members and in another orientation of the extension arm, the pawl and the ratchet are disengaged so that the extension arm is movable together with the movable presser towards and away from the pair of spaced stationary anvil members to bend a pipe without kinking it and to provide smooth continuous bends for different angular shapes.

20 Claims, 6 Drawing Sheets

PIPE BENDING PLIER

BACKGROUND OF THE INVENTION

1. Field of the Invention The invention relates to a pipe bending tool or plier for use in bending hollow copper pipes.

2. Description of the Prior Art

With devices for bending pipes, different tools are required for different diameters of hollow copper pipe and, in some instances, it is necessary to use the services of more than one individual to bend a single pipe.

SUMMARY OF THE INVENTION

The invention is primarily concerned with bending pipes having a bending radius of 12 mm to 39 mm, although the tool can be easily adapted for different diameters of pipes and radii of bends so that the wall thickness will not be damaged.

For example, pipes from 18 mm to 12 mm or from ⅜" to ½" can be bent with a bending pliers conforming with the invention so that they will all have the same 27 mm bending radius and so that will look tidy and the form of the pipe material will remain useful. This is possible because furrows in a presser plate are dimensioned according to the pipe so that when the pipe is pressed with the moving part against correctly dimensioned anvils, the material of the pipe will move because of correctly formed furrows so that the pipe wall will maintain its original thickness and its round pipe form. Therefore, sharper and stronger turns can be made on pipelines with the bending pliers conforming with the invention than can be done with heretofore known methods.

When a tool conforming with the invention is handheld at a working position, with handles downward, the larger furrows are above the body and pipe furrows get smaller when coming down.

To these ends, the present invention consists in a pipe bending plier, comprising a pair of stationary anvil members coupled with a planar plate connected with a housing, a movable presser slidably coupled with the planar plate and movable relative to the housing and the anvil members, movement means coupled with the movable presser for movement of the movable presser towards and away from the anvil members, a fixed handle coupled with the housing and a movable handle pivotally coupled with the housing and a spring coupled with the housing for holding the movable handle away from the fixed handle, the movement means including a pawl-ratchet mechanism housed within the housing and comprising an extension arm on a portion thereof carrying a ratchet, and a pawl connected with the movable handle, the ratchet being coupled with the movable presser and operatively associated with the pawl in one direction of movement of the extension arm for movement by the extension arm in one orientation thereof towards the pair of spaced stationary anvil members and in another orientation of the extension arm, the pawl and the ratchet are disengaged and the extension arm is movable together with the movable presser towards and away from the pair of spaced stationary anvil members.

It is an object of the invention to provide pipe bending pliers which have furrows in a bending part thereof which are deeper than, e.g., the diameter of a ½" pipe and narrower than the diameter of the pipe, and while bending the pipe the shape of the pipe leads to movement of pipe material preventing a change in the outer circumferential form of the pipe and preventing the wall from becoming thinner or distorted when the pipe is being bent for effectively stretching one portion thereof and bending another portion of the pipe.

DESCRIPTION OF THE PREFERRED EMBODIMENTS

Figure 1:
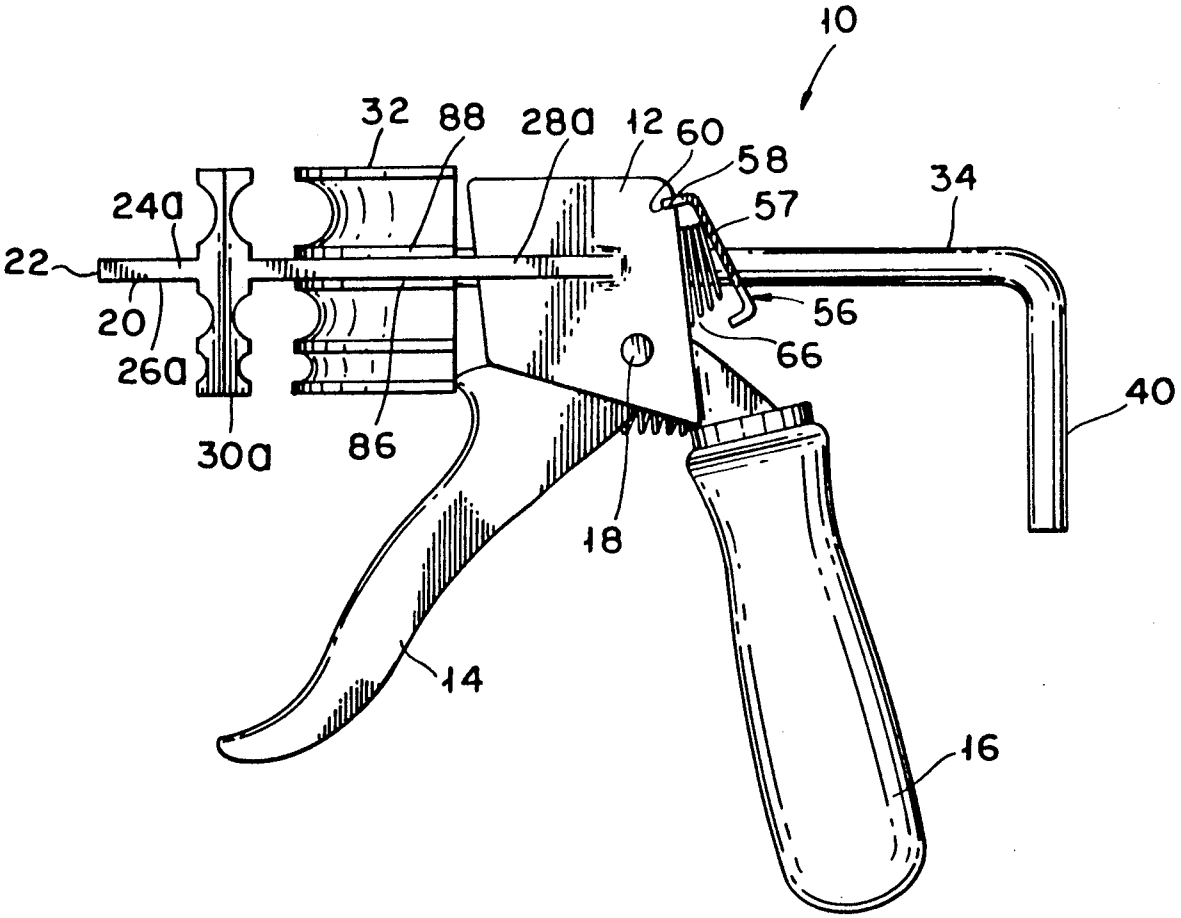
FIG. 1 is a side view of the pipe bending plier according to the invention and showing the extension arm in one of its two positions of operation.

Referring now more particularly to the drawings, a pipe bending plier 10 is shown which includes a housing 12 for housing some of the operating mechanisms coupled with a movable handle 14 movable relative to a stationary handle 16 coupled with and fixedly attached to housing 12.

A planar plate 20 in the form of a U-shaped member includes a base 22, a pair of legs 24*a*, 24*b* each having one end 26*a*, 26*b* connected with base 22 and its free ends 28*a*, 28*b* connected with housing 12. A pair of stationary anvil members 30, one 30*a*, 30*b* for each leg 24, 26 and orthogonally related thereto.

Figure 5:
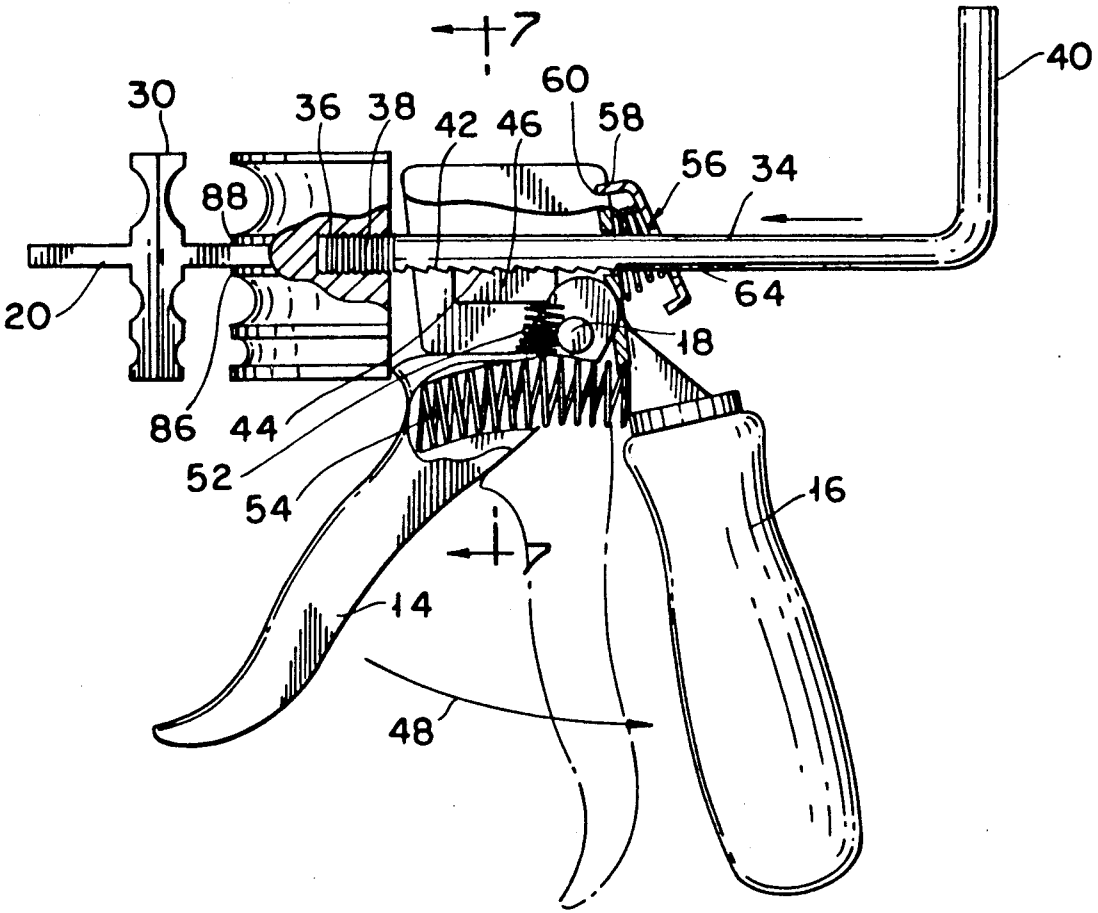
FIG. 5 is a view similar to FIG. 1, but with the extension arm rotated through an angle of 180° so that a pawl member associated with and operated with a movable handle will engage ratchet teeth on the extension arm and be movable in a direction longitudinally of the axis of the extension arm only by the movable handle.

A hollow pipe P shown in phantom is shown positioned on top of planar plate 20, but could equally well have been positioned below, depending on the outer diameter of the hollow pipe P to be bent. Positioned on the other side of pipe P is a movable presser member 32 mechanically intercoupled with extension rod 34 by a screw connection comprising a female connector portion 36 in the presser member 32 and a male screw connection portion 38 at one end of the extension rod 34. The other end of the extension rod 34 is provided with a handle portion 40 so that it can be rotated through an angle of 180° axially along the longitudinal axis of the extension rod 34 to place ratchet teeth 42 into alignment with pawl teeth 44 or pawl 46, as best seen in FIG. 5. In the position shown in FIG. 5, extension rod 34 is fixed in position relative to planar plate 20 and held there by the pawl-ratchet mechanism formed by ratchet teeth 42 and pawl teeth 44. As seen in FIG. 1, handle 40 is rotated through an angle of 180° so that the ratchet teeth 42 are out of engagement with the pawl teeth. In the FIG. 5 orientation, the extension rod 34 is seen in its operative position for moving the movable presser member 32 towards stationary anvil members 30. In the FIG. 1 position or orientation, extension arm 34 is movable by handle 40 longitudinally towards and away from housing 12.

Handle 40 is rotated or moved in a counter-clockwise direction, as viewed in FIG. 5. Handle 14 is coupled with pawl 46 through spring 52 so that as handle 14 is moved towards handle 16 in the direction of arrow 48, spring 52 moves pawl 46 and extension arm 34 in an opposite direction (towards the left side of the drawing) to the movement of handle 14. In the FIG. 6 showing, pawl 46 is not in engagement with ratchet 42 and handle 14 does not move extension arm 34.

Handle 14 is pivotally connected about pivot connection 18 relative to handle 16 and is movable towards handle 16 in the direction of arrow to position shown in phantom at 50 to release pawl teeth 44 by moving pawl 46 in its longitudinal axial direction to cause anvil members 30 and presser member 32 to be brought closer together to impart a bending action to pipe P.

Pawl 46 and pawl teeth 44 are held in engagement with ratchet teeth 42 by spring 52 bearing on pawl 46 and handle 14. Handle 14 as it is rotated towards handle 16 compresses spring 52 and pawl teeth 44 move extension rod 34 towards the left direction, as viewed in FIG. 5, and the front teeth of pawl 46 move out of engagement with ratchet teeth 42 while the rear teeth of pawl 46 impart longitudinal translational movement axially of the longitudinal axis of extension rod 34 to extension rod 34, and upon release of handle 14 which is then moved to its full outline position under pressure from compression spring 54 causes handles 14 and 16 to separate from each other and to rotate pawl 46 in a clockwise manner so that all of pawl teeth 44 are engaged with ratchet teeth 42 and extension rod 34 is moved to cause the gap between the anvil members 30 and presser member to narrow and to cause presser member to move axially of the longitudinal axis to achieve and impart different angular bends to the pipe.

Figure 6:
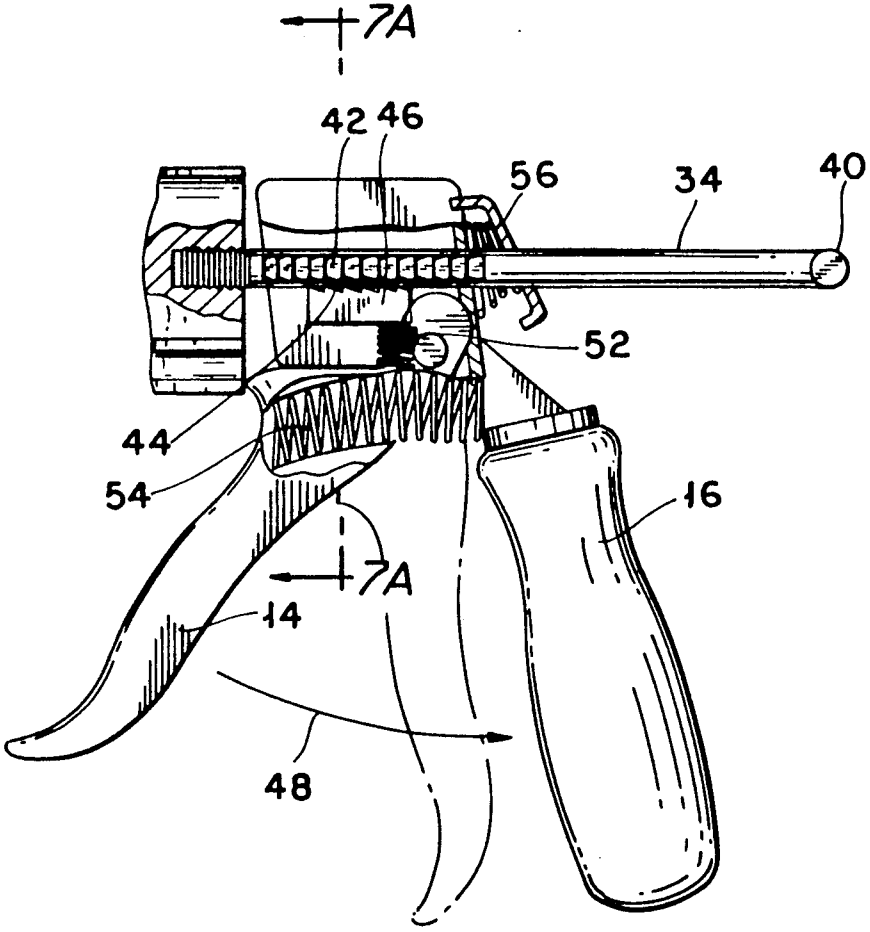
FIG. 6 is a side view with a partial cross-section, as in FIG. 5, but with arm 34 turned through an angle of 90° so that ratchet teeth are no longer engaged with pawl teeth.

In the FIG. 6 position, handle 40 is rotated into a position between the position shown in FIGS. 1 and 5 to show ratchet teeth 42 out of engagement with pawl teeth 44, in a manner similar to FIG. 1, in which handle 40 is rotated through an angle of 180°.

Extension rod clamp member 56 having one end 58 connected with housing 12 at 60. End 58 and housing connection 60 form a pivot connection for clamping member 56 to provide for pivoting thereof relative to housing 12. Clamping member 60 is provided with opening 62 through which extension rod 34 passes. Clamp member 56 at opening 62 is provided with a bearing surface member 64 which is held against the outer surface portion of extension rod 34 by compression spring 66 which urges clamping member 56 away from housing 12 about pivot end 58 and prevents extension rod 3 from being moved axially thereof.

Extension rod 34 is provided with handle 40 so that upon release of clamp member 56 by exerting pressure thereon to overcome spring action of spring 54 and compress the spring, the extension rod 34 is rotatable about its longitudinal axis through an angle of 180° to move ratchet teeth 42 and pawl teeth 44 out of engagement with each other. Once ratchet teeth 42 and pawl teeth 44 are moved out of engagement with each other, movable presser member 32 is movable towards and away from anvil members 30.

Figure 7A:
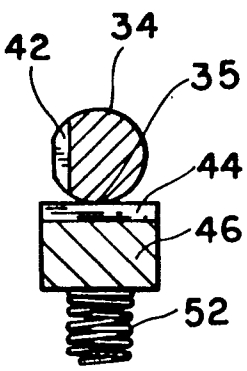
FIG. 7A is an enlarged, partial cross-section taken along line 7—7 of FIG. 5 and shows the ratchet teeth and the pawl teeth disengaged from each other.
Figure 7:
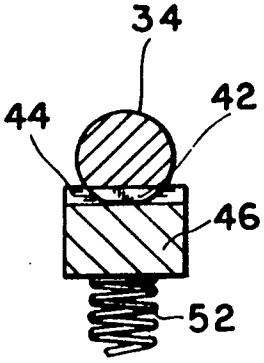
FIG. 7 is an enlarged, partial cross-section taken along line 7—7 of FIG. 5 and shows the ratchet teeth and pawl teeth engaged.

In FIG. 7, spring 52 is shown in its position to exert pressure onto pawl 46 to cause pawl teeth 44 to be engaged with the ratchet teeth 42. In the FIG. 7A position of extension rod 34, with pawl teeth rotated out of engagement with ratchet teeth 42, the pawl teeth bear onto to outer circumferential portion 35 of the extension rod 34 free of the ratchet teeth 42.

Movable presser member 32 is movable along planar plate 20 which is provided with a guideway 68 between legs 24*a*, 24*b* for guiding movable presser member 32. One face 70 of planar plate 20 is provided with indicia markings 72 to provide a preselected indication for different pipe bands or angles, such as 45°, 90°, 135°, and 180°, although different angles can be used in accordance with job requirements.

Movable presser member 32 is a cylindraceous member 74 having a front semi-cylindrical surface portion 76 which is approximately 180° in circumferential extent and a rear side which is shown as a flat side 78 and is the portion containing the female connector portion 36. Presser member 32 on semi-cylindrical surface portion is shown with three partially circumferential undercut portions or furrows 80*a*, 80*b*, 80*c*. While three furrows 80*a*, 80*b*, 80*c* of different dimensions are shown for pipes with outer diameters of different gradations, it is within the scope of the invention to use a presser member having more than three different dimensions.

Figure 3:
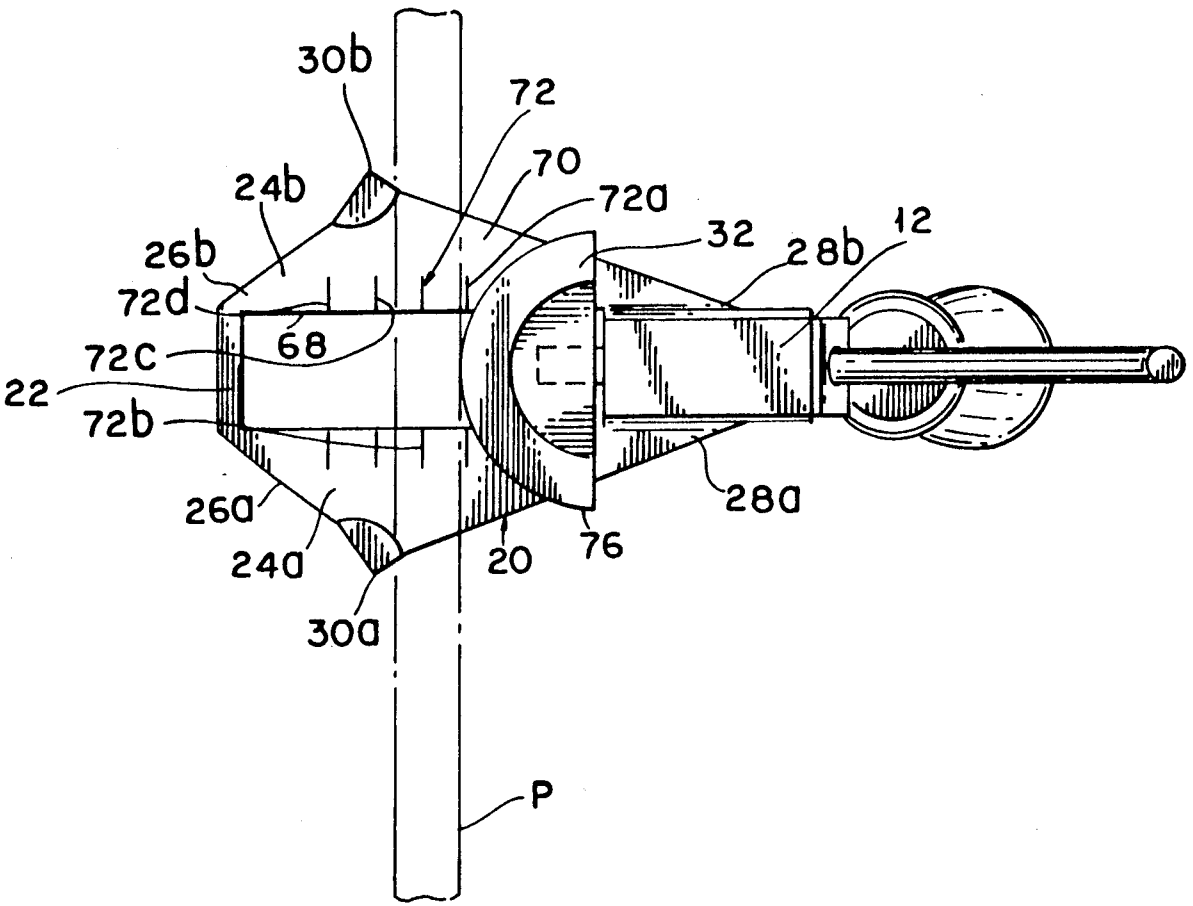
FIG. 3 is a top view of the plier shown in FIG. 2 with a hollow pipe shown in phantom just prior to being bent in accordance with indicia markings.
Figure 4:
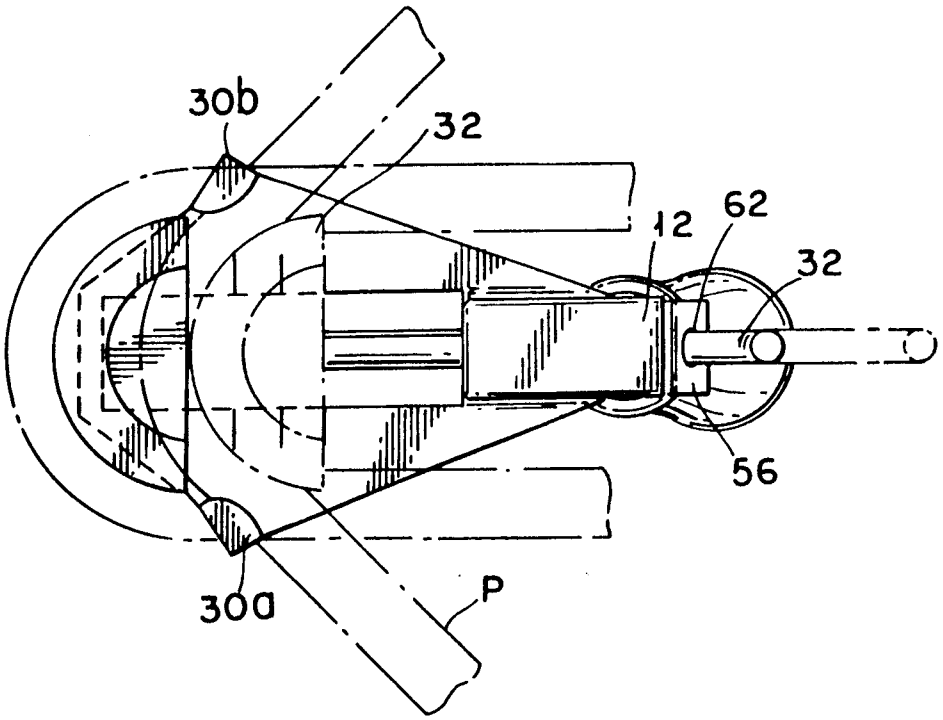
FIG. 4 is another top view similar to that of FIG. 3 showing a hollow pipe in phantom in an intermediate stage of being bent to a preselected angle and in a final stage in which the pipe is bent into a 180° turn, and the intermediate stage is also useful to indicate the hollow pipe being bent into another stage or turn between 0° and 180°, such as a 90° angle.

Anvil members 30*a*, 30*b* cooperate with presser member 32, and each of the anvil members includes an outer cylindraceous surface 82 which includes a partial sector having undercuts or furrows 84*a*, 84*b*, 84*c*, having a curvature complementary to the curvature of furrows 80*a*, 80*b*, 80*c*, respectively. Indicia marking 72*a* is selected so that anvil members 30 and presser member are aligned to have a hollow pipe P as shown in FIG. 3 without a bend. The indicia markings 72*b*, 72*c*, 72*d* are selected in accordance with tangents to the circumferential portions of furrows 80*a*, 80*b* and 80*c* so that they are parallel to tangential portions to the circumferential portions of furrows 84*a*, 84*b* and 84*c*, respectively.

DESCRIPTION OF OPERATION

The pipe bending plier 10 which generally includes a housing 12, a planar plate anvil mechanism coupled with the housing comprising a planar plate 20 connected with the housing and a pair of spaced stationary anvil members 30 coupled with the plate; a movable presser 32 is slidable coupled with the planar plate and movable relative to the housing means 12 and the anvil members; the movable presser is associated with a pawl-ratchet mechanism or movement mechanism for movement of the movable presser towards and away from the anvil members; a fixed handle 16 is coupled with the housing, and a movable handle 14 is pivotally coupled at 18 with the housing and a spring 54 coupled with the housing 12 and handle 14 holds the movable handle away from the fixed handle 16; the mechanism which includes the pawl-ratchet mechanism is housed within the housing and comprises an extension arm 34 carrying on a portion thereof a ratchet 42 and a pawl 46 connected with the movable handle, the ratchet being coupled with the presser 32 and is operatively associated with the pawl 46 in one direction of movement of the extension arm for movement by the extension arm 34 in one orientation thereof towards the pair of spaced stationary anvil members 30 and in another orientation of the extension arm, the pawl teeth 44 and the ratchet teeth 42 are disengaged so that the extension arm is movable together with the movable presser towards and away from the pair of spaced stationary anvil members.

Each of the pair of stationary anvil members includes at least two semi-circular undercut surface portions 84 and each is adapted to conform partially to an outer circumferential surface portion of the hollow pipe P to be bent. The pair of anvil members are aligned by the planar plate 20 so that the axis of the hollow pipe is aligned with the undercut surface portions and is substantially parallel to a plane containing the planar plate. Each of the anvil members includes at least one of the undercut surface portions 8 above the planar plate 20 and at least preferably two of the undercut surface portions below the planar plate for balancing purposes of the tool and ease of handling.

The indicia markings 72 on the planar plate is provided for positioning the presser thereon to impart a pre-designated angular bend to a pipe in accordance with the outer diameter of the pipe.

The clamp member or clamp 56 is associated with the extension arm 34 for holding the extension arm in the one orientation with the pawl and the ratchet engaged. The clamp member is pivotally connected at 58 with the housing at 60 and the spring 66 associated with the clamp member and the extension arm to hold the clamp member in a braking engagement with the extension arm to coact with the pawl and ratchet to hold the pawl and ratchet in engagement with each other. The clamp member has a facing portion 57 for exerting pressure thereon for pivoting thereof to move the ratchet and pawl out of braking engagement with each other, and for movement of bearing surface member 64 out of engagement with extension arm 34. Spring 66 is provided for pressing the clamp member in to braking engagement with the extension arm. The clamp member also controls the direction of movement of the movable presser member 32, permitting movement in one direction and preventing movement in the other direction unless its braking effect is released. One spring 52 is coupled between the pawl and the movable handle for urging the pawl out of engagement with some of the ratchet teeth while leaving the pawl in engagement with one of the ratchet teeth to move the extension arm and the movable presser in a direction towards the anvil members 30. Another spring 54 is coupled between the fixed or stationary handle 16 and the movable handle 14 to keep the handles separated from each other and to keep the one spring 52 compressed to maintain the pawl in engagement with the ratchet in the one orientation of the extension arm.

The movable presser 32 and the extension arm 34 include a connecting mechanism 36, 38 for coupling each together and for de-coupling each from each other. One is a male coupler 38 on the extension arm and a female coupler 36 on the movable presser.

The movable presser 32 includes a semi-cylindraceous member 74 having one outer surface 76 provided with at least one curved undercut portion 80 to conform to the outside diameter of a pipe to be bent. The one outer surface may preferably be provided with a plurality of different undercut portions **80*a*, 80*b*, 80*c* to conform to the outside diameter of preselected pipes to be bent. The movable presser provides for one portion of its outer surface having the outer cylindraceous configuration with undercuts which are un the form of undercut furrows substantially partially coextensive with the outer diameter of the pipe to be bent and another portion having a planar facial surface perpendicular to the longitudinal axis of the extension rod 34, and the stationary anvil members 30 also have furrows 84*a*, 84*b*, 84*c* complementary to the furrows 80*a*, 80*b*, 80*c*** of the movable presser and an outer cylindrical surface portion having tangential portions parallel to tangential portions of the movable presser.

Figure 2:
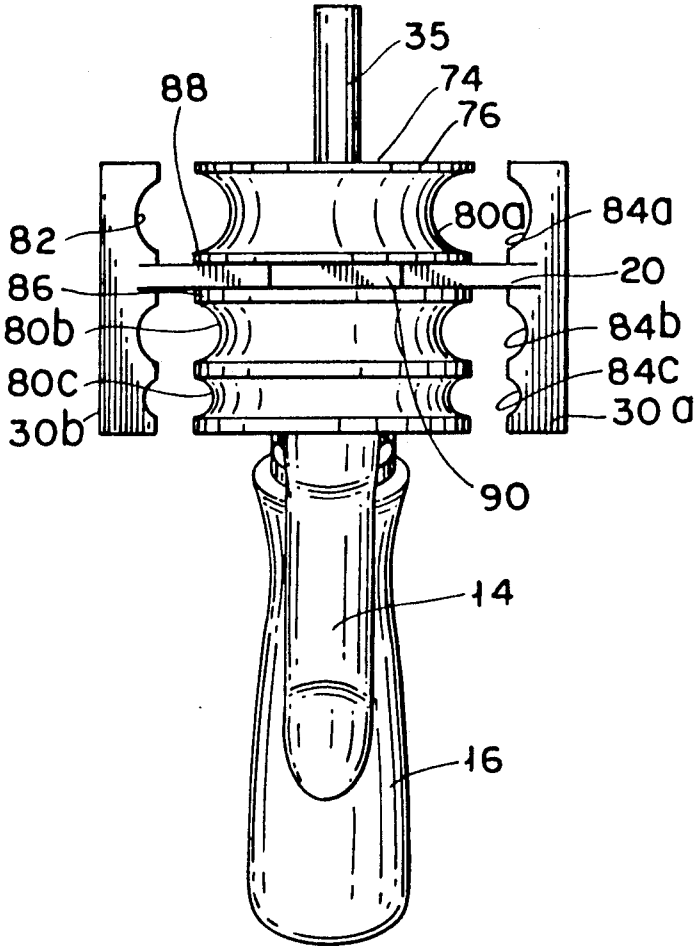
FIG. 2 is a front view of the plier shown in FIG. 1 with a plurality of cooperating pipe bending members shown juxtaposed to each other to receive pipes of different diameter and having surface portions conforming to the outer surface of hollow pipes which are to be bent, but with the extension rod rotated through an angle of 180° from the FIG. 1 position.

The planar plate 20 includes a U-shaped member 21 having each of its legs 24 coupled with the housing 12 to provide a track-guideway **24*a*, 24*b* for the movable presser for movement towards and away from the housing and towards the base of the U-shaped member. The movable presser means includes a pair of oppositely facing face plates 86, 88 in contact with the track-guideway 24*a*, 24*b* for guiding the movement of the movable presser, and a central member 90 (FIG. 2) connecting the oppositely facing face plates 86, 88 together and positioned for movement between each of the legs 24*a*, 24*b*** of the U-shaped member and forming the back guideway. The plier has a longitudinal axis coaxial with the axis of said extension arm, and a major diameter of the movable presser means is transverse to the longitudinal axis.

While there is shown what is considered to be the preferred embodiments of the invention, various modifications and changes may be made without departing from the scope of the invention.

I claim:

1. A pipe bending plier, comprising:

housing means;

planar plate anvil means coupled with said housing means including a planar plate connected with said housing means and a pair of spaced stationary anvil members coupled with said plate;

each of said pair of stationary anvil members including at least two semi-circular undercut surface portions, each adapted to conform partially to an outer circumferential surface portion of a hollow pipe to be bent, and at least one of said undercut surface portions being below said planar plate;

movable pressure means slidably coupled with said planar plate and movable relative to said housing means and said anvil members;

movement means coupled with said movable presser means for movement of said movable pressure means towards and away from said anvil members;

fixed handle means coupled with said housing means and movable handle means pivotally coupled with said housing means and spring means coupled with said housing means for holding said movable handle means away from said fixed handle means;

said movement means including a pawl-ratchet mechanism housed within said housing means an comprising an extension arm on a portion thereof carrying a ratchet, and a pawl connected with said movable handle means, said ratchet being coupled with said movable presser means and operatively associated with said pawl in one direction of movement of said extension arm for movement by said extension arm in one orientation thereof towards said pair of spaced stationary anvil members and in another orientation of said extension arm, said pawl and said ratchet being disengaged whereby said extension arm is movable together with said movable presser means towards and away from said pair of spaced stationary anvil members.

2. The plier as claimed in claim 1, including marking means on said planar plate for positioning said presser means thereon to impart a pre-designated angular bend to a pipe in accordance with the outer diameter of the pipe.

3. The plier as claimed in claim 1, including clamping means associated with said extension arm for holding said extension arm in said one orientation with said pawl and said ratchet engaged.

4. The plier as claimed in claim 3, wherein said clamping means includes a clamp member pivotally connected with said housing, spring means associated with said clamp member and said extension arm to hold said clamp member in a braking engagement with said extension arm to coact with said pawl and ratchet to hold said pawl and ratchet in engagement with each other, and means for pressing said clamp member for pivoting thereof to move said ratchet and pawl out of braking engagement with each other.

5. The plier as claimed in claim 4, including a spring for pressing said clamp member into braking engagement with said extension arm.

6. The plier as claimed in claim 1, wherein said spring means includes a first spring coupled between said pawl and said movable handle means for urging said pawl out of engagement with some of the ratchet teeth while leaving said pawl in engagement with at least one of the ratchet teeth to move said extension arm and said movable presser means towards said anvil members.

7. The plier as claimed in claim 6, wherein said spring means includes a second spring coupled between said fixed handle means and said movable handle means to keep said handle means separated from each other and to keep said first spring compressed to maintain said pawl in engagement with said ratchet in said one orientation of said extension arm.

8. The plier as claimed in claim 1, wherein said movable presser means and said extension arm include means for coupling each together and for de-coupling each from each other.

9. The plier as claimed in claim 10, wherein said coupling means includes a male coupler on said extension arm and a female coupler on said movable presser means.

10. The plier as claimed in claim 1, wherein said plier has a longitudinal axis coaxial with the axis of said extension arm, and a major diameter of said movable presser means is transverse to said longitudinal axis.

11. The plier as claimed in claim 10, wherein said movable presser means includes one portion of its outer surface having an outer cylindraceous configuration with one portion provided with undercut furrows substantially partially coextensive with the outer diameter of a pipe to be bent and another portion having a planar facial surface perpendicular to said longitudinal axis.

12. The plier as claimed in claim 11, wherein said stationary anvil members have furrows complementary to the furrows of said movable presser means and an outer cylindrical surface portion having tangential portions parallel to tangential portions of said movable presser means.

13. The plier as claimed in claim 1, wherein said fixed handle means includes a fixed handle adapted to be received in the palm of the hand and said movable handle means includes a handle adapted to be operated by the fingers of the same hand.

14. A pipe bending plier, comprising:

housing means;

planar plate anvil means coupled with said housing means including a planar plate connected with said housing means and a pair of spaced stationary anvil members coupled with said plate;

movable presser means slidably coupled with said planar plate and movable relative to said housing means and said anvil members;

movement means coupled with said movable presser means for movement of said movable presser means towards and away from said anvil members;

fixed handle means coupled with said housing means and movable handle means pivotally coupled with said housing means and spring means coupled with said housing means for holding said movable handle means away from said fixed handle means;

said movement means including a pawl-ratchet mechanism housed within said housing means and comprising an extension arm on a portion thereof carrying a ratchet, and a pawl connected with said movable handle means, said ratchet being coupled with said movable presser means and operatively associated with said pawl in one direction of movement of said extension arm for movement by said extension arm in one orientation thereof towards said pair of spaced stationary anvil members and in another orientation of said extension arm, said pawl and said ratchet being disengaged whereby said extension arm is movable together with said movable presser means towards and away from said pair of spaced stationary anvil members;

said planar plate including a U-shaped member having each of its legs coupled with said housing to provide a track-guideway for said movable presser means for movement to and from said housing means.

15. The plier as claimed in claim 14, wherein said movable presser means includes a semi-cylindraceous member having one outer surface provided with at least one curved undercut portion to conform to the outside diameter of a pipe to be bent.

16. The plier as claimed in claim 15, wherein said one outer surface is provided with a plurality of different undercut portions to conform to the outside diameter of preselected pipes to be bent.

17. The plier as claimed in claim 14, wherein said movable pressure means includes a pair of oppositely facing face plates in contact with said track-guideway for guiding the movement of said movable presser, and a central member connecting said oppositely facing face plates together and positioned for movement between each of said legs of said U-shaped member.

18. A pipe bending plier, comprising:

housing means;

planar plate anvil means coupled with said housing means including a planar plate connected with said housing means and a pair of spaced stationary anvil members coupled with said plate;

movable presser means slidably coupled with said planar plate and movable relative to said housing means and said anvil members;

movement means coupled with said movable presser means for movement of said movable presser means towards and away from said anvil members;

fixed handle means coupled with said housing means and movable handle means pivotally coupled with said housing means and spring means coupled with said housing means for holding said movable handle means away from said fixed handle means;

said movement means including a pawl-ratchet mechanism housed within said housing means and comprising an extension arm on a portion thereof carrying a ratchet, and a pawl associated with said movable handle means, said ratchet being coupled with said movable presser means and operatively associated with said pawl in one direction of movement of said extension arm for movement by said extension arm in one orientation thereof towards said pair of spaced stationary anvil members and in another orientation of said extension arm, said pawl and said ratchet being disengaged whereby said extension arm is movable together with said movable presser means towards and away from said pair of spaced stationary anvil members; and marking means on said planar plate for positioning said presser means thereon to impart a pre-designated angular bend to a pipe in accordance with the outer diameter of the pipe.

19. The plier as claimed in claim 18, wherein each of said pair of stationary anvil members includes at least two semi-circular undercut surface portions, each adapted to conform partially to an outer circumferential surface portion of a hollow pipe to be bent, and at least one of said undercut surface portions being above said planar plate, and at least one of said undercut surface portions being below said planar plate.

20. The plier as claimed in claim 18, wherein each said pair of anvil members are aligned by said planar plate so that the axis of the hollow pipe aligned with said undercut surface portions is substantially parallel to a plane containing said planar plate.

* * * * *